US010094238B2

(12) United States Patent
Yagami et al.

(10) Patent No.: US 10,094,238 B2
(45) Date of Patent: Oct. 9, 2018

(54) MATERIAL FOR RING ROLLING

(71) Applicant: HITACHI METALS, LTD., Tokyo (JP)

(72) Inventors: Tetsuya Yagami, Yokohama (JP); Toshiya Teramae, Yokohama (JP); Etsuo Fujita, Yasugi (JP); Shinya Nagao, Yasugi (JP); Remi Mukouse, Yokohama (JP); Naoyuki Iwasa, Yasugi (JP); Tsuyoshi Fukui, Yasugi (JP); Chuya Aoki, Yasugi (JP)

(73) Assignee: Hitachi Metals, Ltd., Tokyo (JP)

( * ) Notice: Subject to any disclaimer, the term of this patent is extended or adjusted under 35 U.S.C. 154(b) by 192 days.

(21) Appl. No.: 14/778,013

(22) PCT Filed: Mar. 18, 2014

(86) PCT No.: PCT/JP2014/057262

§ 371 (c)(1),
(2) Date: Sep. 17, 2015

(87) PCT Pub. No.: WO2014/148464

PCT Pub. Date: Sep. 25, 2014

(65) Prior Publication Data

US 2016/0281530 A1 Sep. 29, 2016

(30) Foreign Application Priority Data

Mar. 21, 2013 (JP) ..... 2013-057502

(51) Int. Cl.
*F01D 25/00* (2006.01)
*B21J 1/02* (2006.01)
(Continued)

(52) U.S. Cl.
CPC ..... *F01D 25/005* (2013.01); *B21B 45/004* (2013.01); *B21D 19/04* (2013.01);
(Continued)

(58) Field of Classification Search
CPC combination set(s) only.
See application file for complete search history.

(56) References Cited

U.S. PATENT DOCUMENTS 2,058,007 A 10/1936 Edelmeier
4,084,419 A 4/1978 Dittrich et al.
(Continued)

FOREIGN PATENT DOCUMENTS

CN 1586753 A 3/2005
CN 101020282 A 8/2007
(Continued)

OTHER PUBLICATIONS

Office Action corresponding to Japanese Application No. 2014-016282 dated Apr. 5, 2016.
(Continued)

*Primary Examiner* — Brian Handville
(74) *Attorney, Agent, or Firm* — Myers Bigel, P.A.

(57) ABSTRACT

The present invention provides a high quality material for ring rolling. The material includes radially outer and inner peripheral surfaces. In the material, a center of gravity on a half section is located so as to be closer to the outer peripheral surface in contact with a main roll than a center of the half section in a thickness direction, a shape of the half section includes a height reducing portion having a height from a center line dividing the half section into halves in a height direction, this height is gradually reduced toward the inner peripheral surface in contact with a mandrel roll, and the shape is formed in a substantially linear symmetry such that the center line is a symmetric axis. A height of the inner peripheral surface is from 20% to 50% of a maximum height of the material.

3 Claims, 7 Drawing Sheets

(51) Int. Cl.

| | |
|---|---|
| ***B21J 5/02*** | (2006.01) |
| ***B21H 1/06*** | (2006.01) |
| ***C22C 19/05*** | (2006.01) |
| ***B21K 1/76*** | (2006.01) |
| ***F01D 5/06*** | (2006.01) |
| ***B21B 45/00*** | (2006.01) |
| ***B21D 19/04*** | (2006.01) |
| ***F01D 5/02*** | (2006.01) |
| *C22F 1/10* | (2006.01) |

(52) U.S. Cl.

CPC ..... *B21H 1/06* (2013.01); *B21J 1/02* (2013.01); *B21J 1/025* (2013.01); *B21J 5/02* (2013.01); *B21J 5/022* (2013.01); *B21K 1/761* (2013.01); *C22C 19/05* (2013.01); *C22C 19/055* (2013.01); *C22C 19/056* (2013.01); *F01D 5/02* (2013.01); *F01D 5/06* (2013.01); *C22F 1/10* (2013.01); *F05D 2220/32* (2013.01)

(56) References Cited

U.S. PATENT DOCUMENTS

| | | | |
|---|---|---|---|
| 4,856,167 | A | 8/1989 | Sabroff et al. |
| 5,894,752 | A | 4/1999 | Yano et al. |
| 8,187,532 | B2 | 5/2012 | Ohsone et al. |
| 8,770,005 | B2 | 7/2014 | Kobayashi et al. |

FOREIGN PATENT DOCUMENTS

| | | | |
|---|---|---|---|
| DE | 2504969 | A1 | 8/1976 |
| DE | 42 080 019 | A1 | 12/1992 |
| GB | 2 273 749 | A | 6/1994 |
| JP | 52-131967 | | 11/1977 |
| JP | 54-004275 | | 1/1979 |
| JP | 56-033143 | | 4/1981 |
| JP | 61-238936 | | 10/1986 |
| JP | S63-214564 | A | 9/1988 |
| JP | 07-138719 | | 5/1995 |
| JP | 2011-056548 | | 3/2011 |
| JP | 2011-079043 | | 4/2011 |
| KR | 10-2005-0077368 | A | 8/2005 |
| KR | 10-0612758 | B1 | 8/2006 |
| WO | WO 2008/151399 | A1 | 12/2008 |

OTHER PUBLICATIONS

First Office Action corresponding to Chinese Application No. 201480017170.9 dated Apr. 28, 2016.

International Search Report corresponding to International Application No. PCT/JP2014/057250 dated Jun. 3, 2014.

International Search Report corresponding to International Application No. PCT/JP2014/057262 dated Jun. 3, 2014.

Extended European Search Report, EP 1476789.0, dated Oct. 31, 2016.

MATERIAL FOR RING ROLLING

RELATED APPLICATIONS

This application is a 35 U.S.C. § 371 national phase application of PCT Application PCT/JP2014/0057262 filed Mar. 18, 2014 which claims priority to Japanese Application No. 2013-05702 Mar. 21, 2013. The entire contents of each are incorporated herein by reference in its entirety.

TECHNICAL FIELD

The present invention relates to a material for ring rolling, to be shaped by rolling, to manufacture a ring product to be used in high temperature environments.

BACKGROUND ART

A gas turbine is an example of apparatuses that uses a large number of components, such as heat-resistant steel components, superalloy components, and the like. In the gas turbine, wing-shaped blades are arranged on outer peripheries of a plurality of ring-shaped turbine disks, and an axial flow of fluid (i.e., a flow in an axial direction of a rotational shaft) is converted into rotary motion to generate power. Air is taken in from a front of the gas turbine and is then compressed by multistage axial flow compressing units which are downstream thereto. Furthermore, gas including a mixture of compressed air and fuel is burned in a combustion chamber which is further downstream thereto, to generate high-temperature and high-pressure combustion gas. This combustion gas collides with the blades which are mounted on each turbine disk, while axially flowing in a flow path on the outer periphery of each turbine disk, and this axial motion is converted into rotary motion so that each turbine disk is turned at high speed. Driving force generated by this rotation turns the turbine disk which is before the others thereof, via the rotation axis, and further compresses air so as to provide a continuous turn of the turbine disk.

In recent years, in view of saving energy, it is an important technical demand to improve efficiency of the gas turbine. However, the maximum temperature of the combustion gas to be processed is increased by improvement in the efficiency, and therefore, it is necessary for the gas turbine to be capable of operating at higher temperatures. On the other hand, the turbine disks and the blades in the gas turbine are used while being rotated at high speed, and therefore, there is a problem in that they are subjected to high loads which are applied due to centrifugal force during operation of the gas turbine. In addition, the turbine disks and the blades are exposed to high temperature gas of 600 degrees C. or more, and they are used at locations close to the flow path for the high temperature gas. Therefore, it is absolutely necessary for the turbine disks and the blades to have high strength in a high temperature environment. Furthermore, if they are used in an operation pattern in which start and stop of the operation of the gas turbine occurs intermittently, components of the turbine disks and the blades are subjected to repeatedly applied loads, and as a result, thermal stress which occurs at stages of increasing the temperature and of cooling the components, also repeatedly act on them. Accordingly, it is important for the gas turbine to be configured by components having strength sufficiently high against loads and thermal stress that are repeatedly applied as described above.

In addition, there is a tendency that in order to increase efficiency of the gas turbine, dimensions of rotational bodies, such as the turbine disks and the blades are increased, and therefore, a ring formed of a high-quality material, such as heat resistant steel, superalloy, and the like which can resist higher centrifugal force, is needed. In order to accommodate the above demands, in the inside of the gas turbine, a Ni-based superalloy of which typical examples include austenitic heat resistant steel, ferritic heat resistant steel, and a 718 alloy, are primarily used as the heat resistant steel having high strength in high temperature environments.

It has been known that in the Ni-based superalloy having particularly excellent strength in high temperatures (for example, the 718 alloy), among such abovedescribed alloys, fatigue strength thereof can be improved by refining a metal crystal structure of the material thereof. In addition, various techniques have been suggested for a method of reducing size of grains in the inside of the material. For example, as shown in Patent Literature 1, it has been known that in order to refine the crystal structure, a method of precipitating grains which inhibit coarsening of crystal grains, and the like, are advantageous. In addition, as shown in Patent Literature 2, a method is suggested, in which the material is distorted during hot working so as to promote the phenomenon of refining the grains so that fine grains can be obtained. Regarding a method of producing a ring to be used in high temperature environments, a Ni-based superalloy is more expensive than a normal steel material because the Ni-based superalloy mainly includes rare metals. Therefore, near-net-shape forging is often used, in which a near-net-shape material having a shape close to the finished shape, is used as the material to be cut, and it is further cut so that the amount of chips generated during cutting, is reduced, and as a result, production costs can be reduced.

For the near-net-shape forging, hot forging is generally used. As an example of the production process described above, the hot forging process is used, in which upset forging is applied to a columnar billet so as to shape it in a disk shape, a center portion of the disk-shaped columnar billet is punched, ring rolling is applied to the punched columnar billet so as to shape it as a ring having predetermined diameters, and finally, the ring is shaped so as to have a desired shape of a section thereof, by using a die.

CITATION LIST

Patent Literature

[Patent Literature 1] Japanese Patent Application Laid-Open No. S61-238936

[Patent Literature 2] Japanese Patent Application Laid-Open No. H07-138719

[Patent Literature 3] Japanese Patent Application Laid-Open No. 2011-056548

SUMMARY OF INVENTION

Technical Problem

However, in the ring rolling in which the abovedescribed hot forging process is used, abnormally high temperatures may occur due to heat of production conditions, and as a result, this may cause degradation of product quality. Specifically, in a case in which the Ni-based superalloy, such as the 718 alloy, is used, if the temperature has exceeded 1050 degrees C., grains which inhibit the growth of crystal grains, dissolve in a base material as a solid. As a result, the growth of the crystal grains is activated, and a structure including coarse grains may be generated. Accordingly, it is a significantly important technical demand to produce the ring such that abnormally high temperatures due to heat do not occur at any locations of the Ni-based superalloy during the ring rolling. Furthermore, in the forging process for shaping the material into a final shape, when forming the material so as to have a complicated shape of a section of a component, such as a turbine disk or the like, it is difficult for uniform and optimum distortion to be provided on an entire surface of the material by die forging. Therefore, dead zones may occur, in which almost no distortion is provided during the forging, due to a targeted shape of the forging. In such a case, the phenomenon of refining of the metal crystal structure, which is caused by introduction of distortion, would not sufficiently occur. As a result, coarse grains which cause degradation of fatigue characteristics at low cycles may frequently remain, and this may cause production problems. Accordingly, in a case of producing a material to be shaped by die forging in which ring rolling is used, it is also an important technical demand to previously obtain a structure configured by a fine crystal at the stage of ring rolling which is a preprocess.

Furthermore, as shown in Patent Literature 3, a method is also suggested in which while using one ring-shaped material, a plurality of elements respectively formed in ring-shapes having near net shapes can be obtained in one process by hot rolling while using a main roll and a mandrel roll with special shapes. In this suggestion, differently from the abovedescribed material for ring rolling with a rectangular section, a material for ring rolling with a substantially circular section or a substantially elliptical section is used. However, a purpose of Patent Literature 3 is to omit a hot forging process, and this is very different from conventional techniques. In addition, a shape of the material for ring rolling is not sufficiently considered in Patent Literature 3, and if producing the material for ring rolling with the shape shown in Patent Literature 3, as one shaped product, abnormally high heating may occur locally.

In order to solve the technical problems described above, a purpose of the present invention is to provide a material for ring rolling in which uniform and optimum distortion can be introduced on an entire surface of the material for ring rolling, in particular, a material for ring rolling which is employed as a material for a rotary component used in a high temperature portion of a gas turbine or the like.

Solution to Problem

The present invention has been devised in order to solve the abovedescribed problems. Specifically, according to an aspect of the present invention, a material for ring rolling including a radially outer peripheral surface and a radially inner peripheral surface, the material for ring rolling to be formed (shaped) by hot rolling in which a ring rolling mill having a main roll and a mandrel roll is used and an interval in a radial direction of the material for ring rolling between the main roll and the mandrel roll is reduced, the main roll and the mandrel roll respectively arranged on and in contact with the outer peripheral surface and the inner peripheral surface so as to face each other, wherein: a center of gravity on a half section of the material for ring rolling is located so as to be closer to the outer peripheral surface than a center of the half section in a thickness direction thereof; the material for ring rolling is formed such that a shape of the half section includes a height reducing portion having a height from a center line which divides the half section into halves in a height direction thereof, the height of the height reducing portion is gradually reduced toward the inner peripheral surface, and the shape of the half section is formed with a substantially linear symmetry so as to define the center line as a symmetrical axis thereof; and a height of the inner peripheral surface is from 20% to 50% of a maximum height of the material for ring rolling. According to the abovedescribed feature, a non-constrained portion is formed on the material for ring rolling during the forming in which the ring rolling mill is used, and furthermore, a free space for deforming the material for ring rolling while the ring rolling is being formed.

Advantageous Effects of Invention

As a result of ring rolling being performed by using the material for ring rolling having the features described above, the free space for deforming the material for ring rolling can be secured by the height reducing portion. Accordingly, heating that occurs when the ring rolling is performed, is decreased, growth of crystal grains which may occur due to abnormal heating, can be suppressed, and therefore, a high-quality ring can be obtained. In addition, missing a part of the material on the inner diameter side, which may occur when the rolling is finished, can be reduced, and therefore, a high-quality ring having an extremely accurate shape can be obtained.

As a result, when producing a ring used in high temperature environments in which it is necessary to control sizes of crystal grains during ring rolling, the rolling can be completed within an appropriate temperature range. Accordingly, occurrence of a non-fine metal structure, which is caused by the growth of the grains, can be suppressed, and therefore, a shaped element of a high-quality ring including fine grains in an entire portion of the ring, can be obtained. Furthermore, in a conventional method for producing a ring, in order to prevent the occurrence of abnormal heating when performing ring rolling, rolling with a plurality of heating processes is performed such that the ring rolling is performed until a stage prior to a stage in which the heating may occur, the ring rolling is then suspended, the material for ring rolling is further heated again, and the following processes of the ring rolling are performed. However, in this conventional method, the number of design factors for the process, such as conditions for the suspension of the rolling, and the like, is increased, the amount of labor for determining the process is increased, and furthermore, a management of labor for controlling a structure of the material for ring rolling in a case of the plurality of heating processes, is increased. In contrast, by using the material for ring rolling according to the aspect of the present invention, the temperature of the heating which occurs during the ring rolling can be maintained appropriately, the number of heating processes can be reduced compared with the ring rolling in which the conventional shape is used, and therefore, production time can be shortened.

BRIEF DESCRIPTION OF DRAWINGS

FIGS. 7(*d*) to 7(*f*) are diagrams of which each shows temperature distribution obtained by numerical analysis practiced for an analysis example of the material for ring rolling with a conventional structure.

FIG. 8(*b*) is a diagram which shows distortion distribution obtained by numerical analysis practiced for an analysis example of the material for ring rolling with the conventional structure.

DESCRIPTION OF EMBODIMENT

An Embodiment of the present invention will be described below with reference to the attached drawings.

(Forming of Material for Ring Rolling)

Figure 1A:
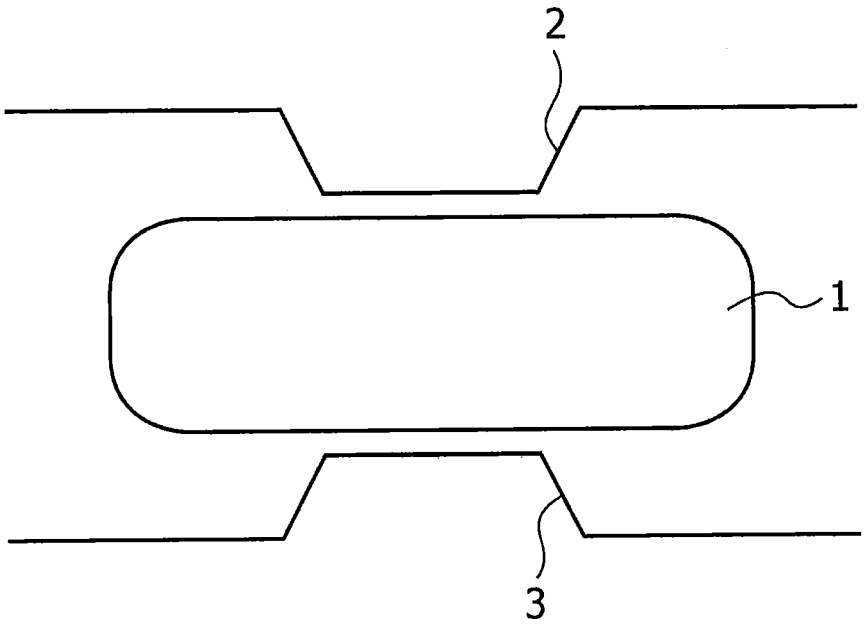
FIGS. 1(*a*) and 1(*b*) are sectional views which schematically show processes of forming of a material for ring rolling according to an Embodiment of the present invention.
Figure 1B:
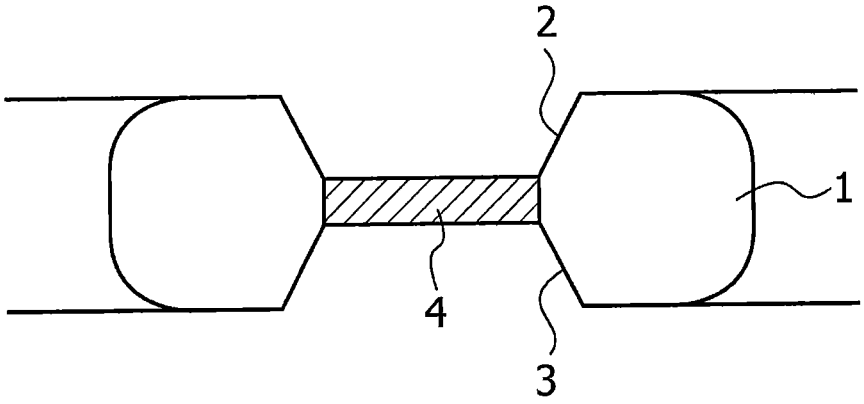

A material for ring rolling, which is used for each disk with a diameter of Φ 1000 mm or more for a gas turbine, will be described as an example of an Embodiment of the present invention. A Ni-based superalloy having excellent high temperature strength is employed as the material for ring rolling. Hereinbelow, an example in which the Ni-based superalloy equivalent to a 718 alloy is used as the material, will be described, and note that as an example of components of the Ni-based superalloy, the Ni-based superalloy has a component structure including 50% to 55% by mass of Ni, 15% to 22% by mass of Cr, 4.5% to 6.5% by mass of Nb, 2.5% to 3.5% by mass of Mo, 0.6% to 1.2% by mass of Ti, and 0.2% to 0.8% by mass of Al, and the other portions constituted by Fe and inevitable impurities. In forming of the material for ring rolling, the disk-shaped Ni-based superalloy 1 having a predetermined height, is heated to a hot process temperature as shown in FIG. 1(*a*), in such a state, the Ni-based superalloy 1 is then pressed in a center thereof as shown in FIG. 1(*b*), by using upper and lower dies (upper and lower molding dies) 2, 3, and note that the upper and lower dies 2, 3 are provided in a hot forging apparatus, a hot pressing apparatus, and the like, and they have a convex portion with a shape of a truncated cone in their center so that a thin portion 4 (a portion shown in FIG. 1(*b*) as a hatched portion) having a space for a concave portion with a shape of a truncated cone is formed. After that, the thin portion provided in the center is cut off so as to form the material for ring rolling. Note that the material can be formed so as to have a desired shape by machining after cutting off the thin portion 4.

(Shape of Material for Ring Rolling)

Figure 2:
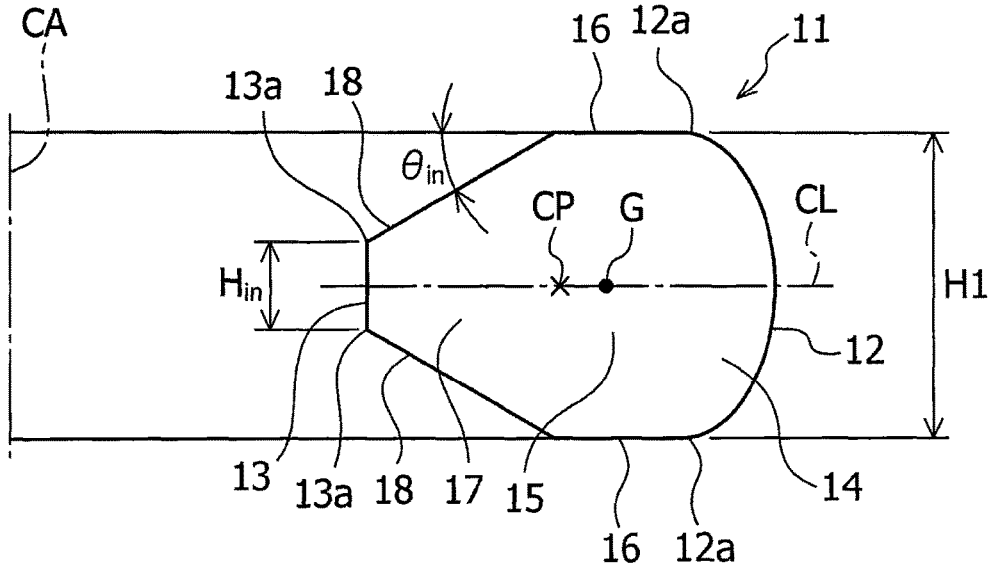
FIG. 2 is a half sectional view which shows an Example of the material for ring rolling according to the Embodiment of the present invention.

FIG. 2 shows an example of a half section of the material 11 for ring rolling obtained by the abovedescribed forming of the material for ring rolling. In FIG. 2, a direction along a central axis CA of the material 11 for ring rolling is defined as a "height direction", and a direction perpendicular to the central axis CA is defined as a "thickness direction". Note that in FIGS. 3 to 5 to be described as follows, the expressions "height direction" and "thickness direction" denote the same direction as those indicated in FIG. 2 respectively. FIG. 2 is the half sectional view which schematically shows the material 11 for ring rolling formed so as to have a shape axisymmetric with respect to the central axis CA (Shape 1). In the Embodiment of the present invention, the expression "half sectional view" indicates a view which shows a portion of the material 11 for ring rolling on one side thereof in the thickness direction relative to the central axis CA. That is to say, a left portion of the material 11 for ring rolling is omitted in the drawing.

This material 11 for ring rolling has a radially outer peripheral surface 12 and a radially inner peripheral surface 13. The material 11 for ring rolling includes an outer peripheral portion 14 which has the outer peripheral surface 12. The outer peripheral surface 12 is a part of the peripheral edge of the outer peripheral portion 14, and this part forms a contour of the half section. The outer peripheral portion 14 is located so as to be close to the outer periphery of the material 11 for ring rolling relative to a boundary line (not shown) which linearly connects both end portions 12*a* of the outer peripheral surface 12 in the height direction. The shape of the half section of the material 11 for ring rolling shown in the drawing, includes a linear portion 15 provided at a location close to the center portion in the thickness direction. This linear portion 15 includes an end surface 16 which is directed in the height direction and is linearly extended. A length of the linear portion 15, preferably a length of the end surface 16 of the linear portion 15, is approximately ⅔ times of a maximum height H1 of the material 11 for ring rolling. A height reducing portion 17 is provided so as to be connected to the linear portion 15. This height reducing portion 17 is formed so as to have a tapered shape, and a height of the height reducing portion 17 from a center line CL which divides the half section into halves in the height direction, is gradually reduced toward the inner peripheral surface 13 which is in contact with a mandrel roll. A height Hin on a side of an end of the inner diameter (the inner peripheral surface 13) is equal to or more than ⅓ times (33%) of the maximum height H1 of the material 11 for ring rolling and equal to or less than ½ times (50%) thereof. In addition, a length of the height reducing portion 17 in the thickness direction, preferably a length of a line that a slanted surface 18 of the height reducing portion 17 extending from a highest point of the height of the material 11 for ring rolling, is projected on the center line CL in the height direction, is set within a range which is from 0.2 times to 1.5 times of the maximum height H1 of the material 11 for ring rolling. Furthermore, the height reducing portion 17 is formed so as to have the following shape, and that is to say, the shape is tapered from the both end portions 12*a* of the outer peripheral surface 12 in the height direction, which is formed on the side of the main roll, toward both end portions 13*a* of the inner peripheral surface 13 in the height direction, while the shape includes a linear-shaped portion having a predetermined length. The shape of the half section is also substantially linearly symmetrical so as to define the center line CL as a symmetrical axis. Note that a center of gravity (or a center of the figure) G on the half section of the material 11 for ring rolling is located so as to be closer to the main roll from a center CP of the material 11 for ring rolling in the thickness direction, i.e., is located on a side of the outer peripheral surface 12. In the drawing, the center CP in the thickness direction is indicated by an x mark, and the location of the center of gravity G is indicated by a solid circle.

Figure 3:
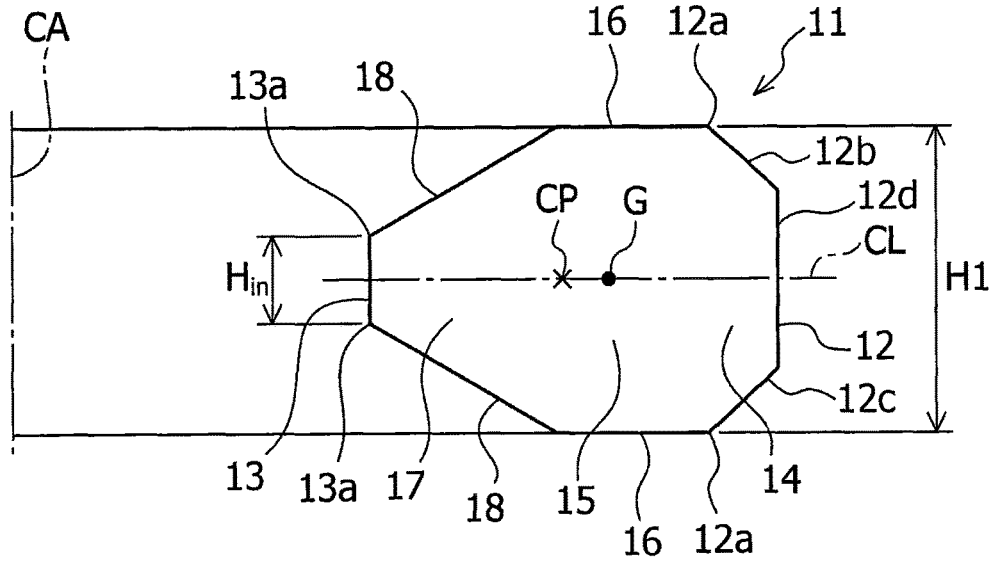
FIG. 3 is a half sectional view which schematically shows a First Modification of the material for ring rolling according to the Embodiment of the present invention.
Figure 4:
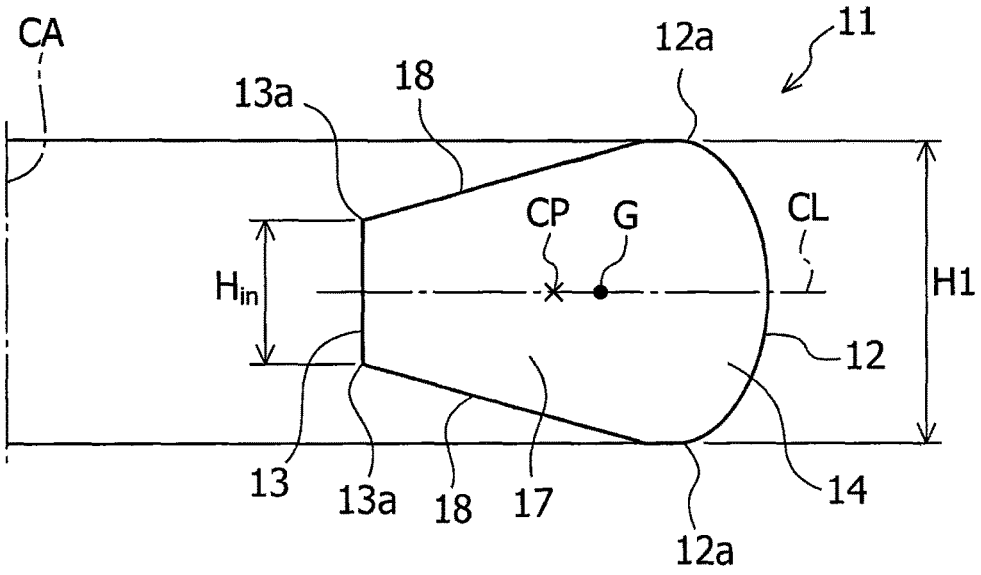
FIG. 4 is a half sectional view which schematically shows a Second Modification of the material for ring rolling according to the Embodiment of the present invention.
Figure 5:
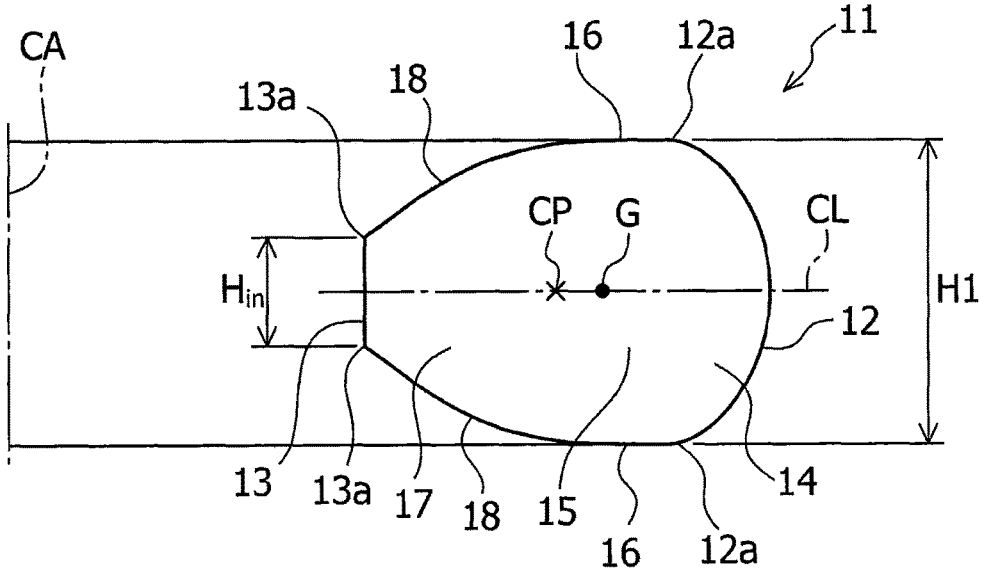
FIG. 5 is a half sectional view which schematically shows a Third Modification of the material for ring rolling according to the Embodiment of the present invention.

FIGS. 3 to 5 show a First Modification to a Third Modification of the material 11 for ring rolling, respectively. To begin with, in the half sectional view of the material 11 for ring rolling of the First Modification shown in FIG. 3 (Shape 2), an upper portion 12*b* and a lower portion 12*c* of the radially outer peripheral surface 12 in the height direction as described above in FIG. 2, include a tapered portion. An intermediate portion 12*d* which connects the upper and the lower tapered portions, has a linear shape. According to the shape shown in FIG. 3, the upper portion 12*b* and the lower portion 12*c* of the outer peripheral surface 12 include the tapered portions, respectively, the intermediate portion 12*d* which connects the upper and the lower tapered portions, is formed so as to have a linear shape, and therefore, a contact area between the main roll and the material 11 for ring rolling at a start of the ring rolling, can be increased so that the ring rolling can be stable. Examples of methods of which each is used to obtain this shape, include a method in which the shape is arranged by machining after the abovedescribed shape shown in FIG. 1 is obtained. For example, in this method, a set of dies which includes the upper and lower dies 2, 3 and is formed so as to obtain the shape shown in FIG. 3, is used in the abovedescribed forming of the material for ring rolling. If a method in which machining is practiced, is used, accuracy of the shape can be improved, and on the other hand, the production yield may become worse. Therefore, it is advantageous to form (shape) the shape shown in FIG. 3 by using the shape of the die used at a stage of hot forging (including hot pressing). If the shape of the material 11 for ring rolling shown in FIG. 3, is applied to the shape of the die used at the stage of the hot forging, a distance from the central axis CA of the material 11 for ring rolling to the outer peripheral surface of the main roll, and a distance from the central axis CA of the material 11 for ring rolling to the outer peripheral surface 12, can be set the same as each other by controlling the shape of the die. As a result, the ring rolling can be more stably performed. Note that if the shape shown in FIG. 3 is shaped by hot forging, a press load becomes higher compared with a case in which the shape shown in FIG. 2 is applied. Accordingly, it can be determined to apply whether the shape shown in FIG. 3 or the shape shown in FIG. 2 while considering a maximum load of the forging apparatus to be used, a maximum load applied during the forging, and the like.

Next, the material 11 for ring rolling of the Second Modification shown in FIG. 4 (Shape 3) has a shape linearly tapered from the both end portions 12*a* of the outer peripheral surface 12 in the height direction, which is formed on the side of the main roll, toward the both end portions 13*a* of the inner peripheral surface 13 in the height direction. Examples of methods of which each is used to obtain this shape include a method in which the shape is arranged by machining after the abovedescribed shape shown in FIG. 1 is obtained. For example, in this method, a set of dies which include the upper and lower dies 2, 3 and is formed so as to obtain the shape shown in FIG. 4, is used in the abovedescribed forming of the material 11 for ring rolling. If a method in which machining is practiced, is used, accuracy of the shape can be improved, and on the other hand, the production yield of the material may become worse. Therefore, it is advantageous to form (shape) the shape shown in FIG. 4, by using the shape of the die. Note that in FIG. 4, the outer peripheral surface 12 is formed so as to have a curved surface shape. However, if a part of the curved surface shape which is brought into contact with the main roll first, is worked so as to be flat, a contact area between the main roll and the material 11 for ring rolling at a start of ring rolling, can be increased, and as a result, the ring rolling can be stably performed. Alternatively, as a matter of course, an entire curved surface shape on the side of the outer peripheral surface 12 may be worked so as to be flat. In the material 11 for ring rolling illustrated in the half sectional view in FIG. 5 which shows the Third Modification (Shape 4), the inner peripheral surface 13 in contact with the mandrel roll, is formed so as to have a linear shape, and the other portions are formed so as to have curved surface shapes respectively. To obtain this shape, the material can be shaped by for example, a method in which the upper and the lower dies 2, 3 are formed so as to have the shape shown in FIG. 4 in the abovedescribed forming of the material for ring rolling, or a method in which a height of the convex portion with the truncated cone shape, which is formed on the upper die 2 and on the lower die 3, is increased in the abovedescribed forming of the material for ring rolling. Note that the ring rolling can be more stably performed by using each of the shapes shown in FIGS. 2 and 3 among the shapes shown in FIGS. 2 to 5.

Next, reasons for limitation to each shape of the material 11 for ring rolling according to the Embodiment of the present invention will be described. As described above, the material 11 for ring rolling has the shape which is tapered toward the side of the inner peripheral surface 13 formed by the height reducing portion 17, and therefore, the center of gravity G in the material 11 for ring rolling is located so as to be closer to the side of the center CP than the center CP of the material 11 for ring rolling in the thickness direction, i.e., is located on the side of the outer peripheral surface 12. According to the abovedescribed shape, the contact area between the mandrel roll and the material 11 for ring rolling can be controlled so as to be smaller. By this feature, the ring rolling can be performed while reducing the load applied during the ring rolling at the same time. Accordingly, in particular, local occurrence of heating on the material 11 for ring rolling which is in contact with the mandrel roll, can be reduced. In addition, the height Hin of the inner peripheral surface 13 of the material 11 for ring rolling is controlled so as to be from 20% to 50% of the maximum height H1 of the material 11 for ring rolling so that the deformation occurs one after another in the height reducing portion 17 of the material 11 for ring rolling during the ring rolling, and the ring rolling can be performed with a relatively low pressing force. If the height Hin of the inner peripheral surface 13 becomes less than 20% of the maximum height H1 of the material 11 for ring rolling, the contact area between the mandrel roll and the inner peripheral surface 13 is decreased, and therefore, it becomes easy for the material 11 for ring rolling to fall on either of upper side or lower side during the ring rolling so that the ring rolling may become unstable. On the other hand, if the height Hin of the inner peripheral surface 13 exceeds 50% of the maximum height H1 of the material 11 for ring rolling, abnormally high heating may occur. Specifically, if the conditions provided in the Embodiment of the present invention, such as the shape of the section, the location of the center of gravity G, and a relationship between the height Hin of the inner peripheral surface 13 and the maximum height H1 of the material 11 for ring rolling, are appropriately controlled, local occurrence of heating on the material 11 for ring rolling can be suppressed while a hot workability can be enhanced.

Furthermore, in order to more securely obtain the above-described advantageous effects, a lower limit of the height Hin of the inner peripheral surface 13 is preferably 25% of the maximum height H1 of the material 11 for ring rolling, and is more preferably 33% thereof. On the other hand, an upper limit of the height Hin of the inner peripheral surface 13 is preferably 45% of the maximum height H1 of the material 11 for ring rolling, and is more preferably 40% thereof. The expression "height of the inner peripheral surface 13" indicates an interval between the both end portions 13*a* of the inner peripheral surface 13 in the height direction, which has a curvature of a great difference relative to the curvature of the slanted surface 18 of the height reducing portion 17. For example, in the half sectional views shown in FIGS. 2 to 5, the "height of the inner peripheral surface 13" indicates a length of the linear part in contact with the mandrel roll. Note that even if there is a slightly curved surface or a slightly convex and concave shape on the inner peripheral surface 13 so that it becomes inaccurate to measure the height Hin of the inner peripheral surface 13, the measurement can be performed at a location being within a range which is equal to or less than 20 mm, from the location in contact with the mandrel roll first toward the outer periphery having a curvature of a great difference relative to the curvature of the height reducing portion 17.

As shown in FIGS. 2 to 5, the material 11 for ring rolling is formed in a substantially linearly symmetry so as to define the center line CL as the symmetrical axis. By using the shape which is formed in the substantially linearly symmetry so as to define the center line CL as the symmetrical axis, the ring rolling can be stably performed. Regarding the "substantially linearly symmetry", for example, if a die in which the outer peripheral surface 12 would not be constrained, is used to perform the shaping of the material for ring rolling in the abovedescribed manner by hot forging, a complete linear symmetry may not be obtained in some cases. Therefore, the expression "substantially linearly symmetry" in the present invention denotes a shape that may tolerate occurrences of errors, deviations of the shape, and the like in the abovedescribed forming of the material for ring rolling. Furthermore, in the Embodiment of the present invention, the height reducing portion 17 is provided as shown in FIGS. 2 to 5. The height reducing portion 17 becomes a free space for deformation of the material 11 for ring rolling during the shaping by using a ring rolling mill, and in particular, by this feature, occurrence of excessive heating on the material 11 for ring rolling on the side of the mandrel roll can be prevented. Regarding the height reducing portion 17, as described above, in the Embodiment of the present invention, the height reducing portion 17 can be shaped by pressing in the center thereof while using the upper and the lower dies 2, 3 of which each has the convex portion with a truncated cone shape in the center thereof. In this case, the length of the height reducing portion 17 in the thickness direction becomes longer according to decreasing of the angle of the truncated cone-shaped convex portion. However, if the length of the height reducing portion 17 in the thickness direction is set to be excessively longer, time for working the height reducing portion 17 during the ring rolling may become longer. On the other hand, according to increasing the angle of the truncated cone-shaped convex portion, the length of the height reducing portion 17 in the thickness direction becomes smaller. However, if the length becomes excessively shorter, a mortar-shaped portion to be cut off after the pressing, is increased, and this may degrade the production yield. In addition, if an area of pressing surface of the convex portion is increased, it becomes necessary to press the die with a higher pressing force, and as a result, it becomes necessary to use a special forging apparatus in which a high load can be applied. In this case, the temperature of the material 11 for ring rolling may become locally high during the ring rolling.

Therefore, in the Embodiment of the present invention, the length of the height reducing portion 17 in the thickness direction, preferably the length of the line obtained by projecting the slanted surface 18 of the height reducing portion 17 onto the center line CL in the height direction, is from 0.2 times to 1.5 times of the maximum height H1 of the material 11 for ring rolling. In this relationship, a lower limit of the length of the height reducing portion 17 in the thickness direction is preferably 0.5 times of the maximum height H1, and is more preferably 0.6 times thereof. On the other hand, an upper limit of the length of the height reducing portion 17 in the thickness direction is preferably 1.1 times of the maximum height H1, and is more preferably 1.0 times thereof.

In the material 11 for ring rolling according to the Embodiment of the present invention, the outer peripheral portion 14 in contact with the main roll is preferably formed so as to have the shape tapered toward the outer periphery. The material 11 for ring rolling shown in each of FIGS. 2 to 5 is formed so as to have the tapered shape. If the above-described shape is applied, and the dies in which the outer peripheral surface 12 is constrained by hot forging in the shaping of the material for ring rolling, are used, for example, the dies can be used for the ring rolling, and this is economically advantageous. Furthermore, if the outer peripheral surface 12 in contact with the main roll during the ring rolling, has a flat portion as described above, the ring rolling can be stably performed. Accordingly, it is preferable to provide a flat portion in a part of the outer peripheral portion 14 which is in contact with the main roll, in the material 11 for ring rolling. In this feature, it is preferable to provide a flat portion (i.e., a portion of the outer peripheral surface 12 with a linear shape in the drawing) having a length approximately ⅙ times or longer and ⅓ times or shorter of the maximum height H1. In addition, in the Embodiment of the present invention, the linear portion 15 including both end surfaces in the height direction, which are substantially linearly extended, may be provided between the outer peripheral portion 14 and the height reducing portion 17. Regarding the linear portion 15, if an axial roll is used for the ring rolling, and a flat portion used for pressing by the axial roll is provided, the ring rolling can be performed stably, and a desired shape thereof can be obtain more easily. In this order, a preferable length of the linear portion 15, more preferably a length of the end surface 16 of the linear portion 15, is more than 0 times of the maximum height H1 of the material 11 for ring rolling and is equal to or less than ⅔ times thereof. Although not limiting the present invention particularly, the thickness (material thickness) of the material 11 for ring rolling may be 0.5 times or larger of the maximum height H1 of the material 11 for ring rolling. This limitation is determined while considering a threat of buckling which may occur in subsequent hot forging if the material is excessively thin, because the material 11 for ring rolling according to the Embodiment of the present invention is worked into a shape of a final product by hot forging which is further performed after the ring rolling (the hot forging which includes a forging and a pressing at a hot temperature and a constant temperature).

The angle in the material 11 for ring rolling, which is indicated as "θin", is preferably equal to or more than 20 degrees. If the angle θin is less than 20 degrees, the height reducing portion 17 becomes longer, and this may lead to increase of time for ring rolling. In this case, weight of the thin portion 4 to be cut off after the hot working, such as hot forging and hot pressing, may be increased, and as a result, this may also degrade the production yield. On the other hand, if the angle θin exceeds 70 degrees, it becomes easy for local heating to occur on the radially inner periphery surface during the ring rolling. In this case, since the Ni-based superalloy 1 would not fully extend inside the upper and the lower dies 2, 3 during the hot working, it becomes difficult to obtain the desired shape thereof. A lower limit of the angle θin at which these problems can be more securely prevented, is preferably 25 degrees. An upper limit of the angle θin is preferably 45 degrees, and is more preferably 30 degrees.

(Ring Rolling Process Performed in Forming Heat-Resistant Alloy Ring)

The material 11 for ring rolling described above, is ring-rolled by using the ring rolling mill. As the ring rolling mill used in the ring rolling, a mill which has a feature shown in FIG. 6, can be employed. Note that the ring rolling mill may also include guide rolls (centering rolls) and a sizing roll. In the ring rolling mill shown in FIG. 6, a main roll 21 which can rotate at a predetermined rotational speed, and a mandrel roll 22 which can be rotationally driven around an axis thereof, are arranged so as to face each other on the radially outer peripheral surface 12 and the radially inner peripheral surface 13 of the material 11 for ring rolling. Furthermore, the ring rolling mill also includes two axial rolls 23A, 23B which are arranged so as to face each other on the upper surface and the lower surface of the material 11 for ring rolling in the height direction. If guide rolls which can be rotationally driven, are arranged on both sides of the main roll 21, and the rolling is performed while the outer peripheral portion 14 of the material 11 for ring rolling is supported in order to reduce and suppress misalignment of the material 11 for ring rolling from the center, which may occur during rolling, the rolling can be more stably performed.

The main roll 21 is formed so as to have a columnar shape. This main roll 21 is rotationally driven in a state in which it is brought into contact with the outer peripheral surface 12 of the material 11 for ring rolling so that the material 11 for ring rolling is turned during the ring rolling. For the mandrel roll 22, a cylindrically shaped roll is used. This mandrel roll 22 is configured so as to be freely rotatable around the axis thereof, and is arranged substantially in parallel to the rotational axis of the main roll 21. The rolling is performed in a state in which the outer peripheral surface of the mandrel roll 22 is in contact with the inner periphery surface 13 of the material 11 for ring rolling. During this rolling, a distance of rolls between the main roll 21 and the mandrel roll 22 is gradually reduced, and as a result, a portion between the radially inner periphery surface 13 and the radially outer peripheral surface 12 of the material 11 for ring rolling is pressed in the thickness direction. The upper and the lower axial rolls 23A, 23B are formed so as to have a conical shape or a truncated conical shape with a vertical angle of 20 degrees to 45 degrees. Furthermore, in order to adjust a dimension of the material 11 for ring rolling in the height direction, the upper and the lower axial rolls 23A, 23B are respectively arranged such that each tip thereof may be oriented to the substantial center of the material 11 for ring rolling. Note that the upper and the lower axial rolls 23A, 23B rotationally drive according to the rotational speed of the material 11 for ring rolling, and alternatively, the upper and the lower axial rolls 23A, 23B may be rotationally driven.

Regarding the process of the rolling, the mandrel roll 22 is inserted through an inner diameter hole of the material 11 for ring rolling, which was heated to a predetermined temperature. The mandrel roll 22 is then gradually moved radially outward such that the interval between the main roll 21 and the mandrel roll 22 may be gradually reduced. After that, when the distance between them became equivalent to the thickness of the material 11 for ring rolling in its initial state, the material 11 for ring rolling is turned due to friction between the surface of the main roll 21 and the outer peripheral surface 12 of the material 11 for ring rolling. In this process, the mandrel roll 22 is rotationally driven so as to follow the rotation of the material 11 for ring rolling. Subsequently, the interval between the main roll 21 and the mandrel roll 22 is gradually reduced by gradually moving the mandrel roll 22 radially outward (toward the outer periphery). Therefore, the material 11 for ring rolling is pressed in the thickness direction, and the material 11 for ring rolling is plastically deformed along the circumferential direction of the material 11 for ring rolling in a continuous manner. The material 11 for ring rolling used in this process has the abovedescribed shape provided in the present invention.

(Advantageous Effects)

Advantageous effects which can be obtained by rolling the material 11 for ring rolling having the shape of the section described above while using the abovedescribed ring rolling mill, will be described below. Hereinbelow, in order to verify action obtained when deforming the portion on the inner peripheral side, which is formed so as to have the tapered shape, the advantageous effects will be described with reference to analysis examples of numerical simulations that were performed by using a calculator. However, in the analysis examples, in order to simplify the numerical calculations, the guide rolls, which may not directly influence the forming, were excluded from subjects of the modeling. For a condition of rolling in which the outer diameter of the material 11 for ring rolling with the shape of the half section shown in FIG. 2, is increased by 1.2 times thereof, a numerical analysis of ring rolling was practiced by using a three-dimensional rigid-plastic finite element analysis method. Note that an outer diameter of the material 11 for ring rolling was φ 600 mm, a maximum thickness of the material 11 for ring rolling was 100 mm, and a thickness of the material 11 for ring rolling on the inner diameter side was 40 mm. While considering a symmetry that a symmetrical surface CL having a shape of a section of the material 11 for ring rolling in a peripheral direction thereof (the symmetrical surface CL which is equivalent to the center line CL viewed from the half section) is a symmetry criterion, displacement of joints which were located on the symmetrical surface CL in the direction of outside of the surface, was constrained, and portions on an upper side of the symmetrical surface CL were used as subjects of the analysis. For the mandrel roll 22 and the axial roll 23A, the condition were set such that they were respectively rotatable around their axes. The diameter of the main roll 21 was φ 800 mm, and the main roll 21 was rotatable at a constant speed of 20 revolutions per minute (RPM). Note that the initial heating temperature was set at 980 degrees C. For data of hot flow stress obtained when the alloy equivalent to the 718 alloy was used as the material, data obtained by a compressing test performed at the test temperature ranging from 700 degrees C. to 1100 degrees C., was used.

Each of FIGS. 7(*a*) to 7(*c*) shows a changed pattern in the shape of the section in the course of the rolling obtained by the numerical analysis, and distribution of temperature thereof. For comparison, each of FIGS. 7(*d*) to 7(*f*) shows a changed pattern in the shape of the section in the course of the rolling performed by using a material for ring rolling having the conventional rectangular section under the same condition as that described above, and distribution of temperature thereof. In FIG. 7, the dot-and-dash line indicated as "CL", denotes the center line. All of the FIGS. 7(*a*) to 7(*f*) show results of simulations for the upper half of the half section which is divided across the center line CL. Note that FIGS. 7(*a*) to 7(*c*) and FIGS. 7(*d*) to 7(*f*) include diagrams in states of timings at which the mandrel roll 22 and the main roll 21 were at their initial positions while being in contact with the outer peripheral surface 12 and the inner periphery surface 13 of the material 11 for ring rolling (FIGS. 7(*a*) to 7(*d*)), diagrams in states of timings at which the outer diameter of the material 11 for ring rolling was increased by 3% (FIGS. 7(*b*) and 7(*e*), and diagrams in states of timings at which the outer diameter of the material 11 for ring rolling further was increased by 20% (FIGS. 7(*c*) and 7(*f*)).

When seeing the material 11 for ring rolling passing through the main roll 21 and the mandrel roll 22 on a virtual plane which is arranged along the rotational axes of the main roll 21 and the mandrel roll 22 so as to include the rotational axes, in a condition in which the material 11 for ring rolling was pressed in the thickness direction, the dimension thereof in the thickness direction was decreased according to time passage. However, volume of the material 11 for ring rolling itself is constant during the plastic deformation, and as a result, flow of material in the peripheral direction would occur. Furthermore, in the region between the mandrel roll 22 and the main roll 21, the mandrel roll 22 and the main roll 21 are not constrained in the axial direction, and therefore, components of flows in the height direction would also be provided. In the rolling of the material 11 for ring rolling according to the Embodiment of the present invention, the material 11 for ring rolling includes the height reducing portion 17 (having the tapered shape), and therefore, for the flow on the inner side, the region of the tip of the tapered shape to form the free space selectively, is deformed at the initial stage. In this process, the upper and the lower axial rolls 23A, 23B are located on a portion of the maximum thickness, and therefore, the deformation is advanced freely in the height direction in the region on the side of the inner peripheral surface 13.

Figure 8A:
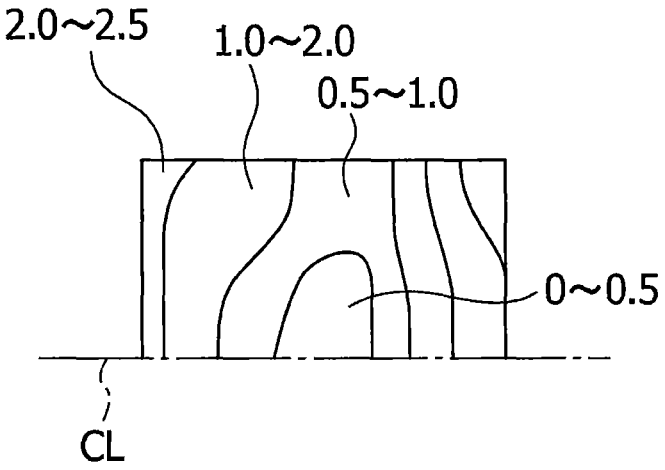
FIG. 8(*a*) is a diagram which shows distortion distribution obtained by numerical analysis practiced for an analysis example of the material for ring rolling according to the Embodiment of the present invention.
Figure 8B:
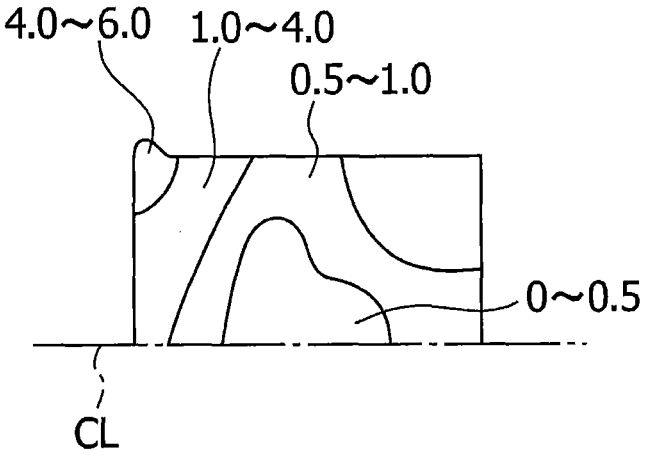
Figure 9A:
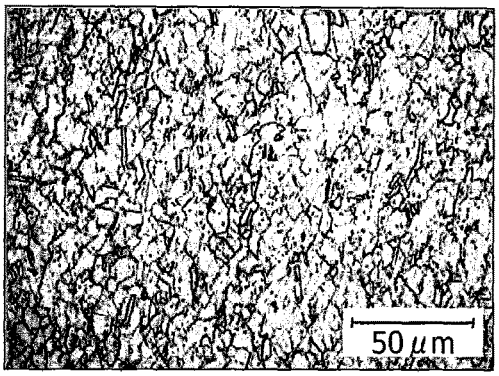
FIGS. 9(*a*) to 9(*e*) are diagrams each showing a metal structure of an upper portion, an inner diameter portion, a center portion, an outer diameter portion, and a lower portion of the material for ring rolling according to an Embodiment of the present invention by a macrophotograph.
Figure 9D:
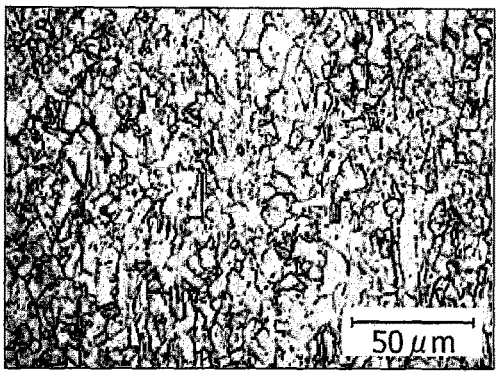
Figure 9B:
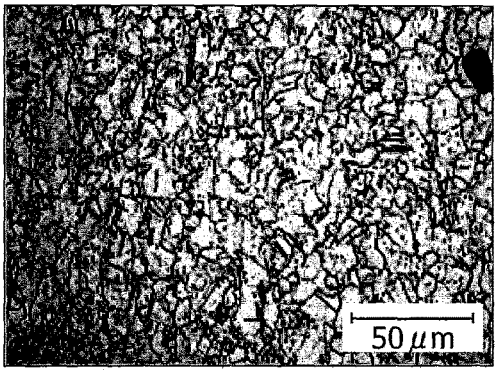
Figure 9E:
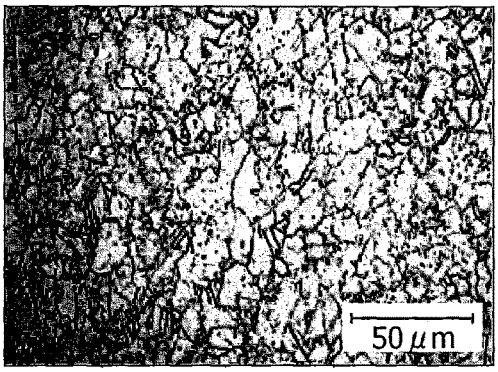
Figure 9C:
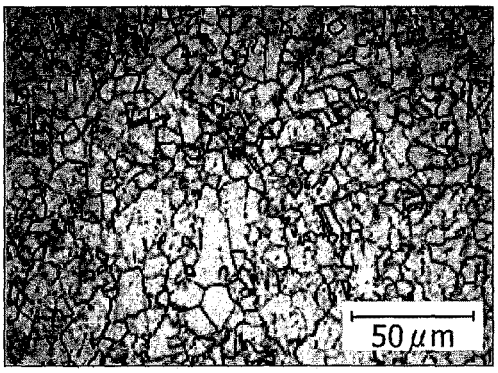

When seeing the temperature distribution shown in FIGS. 7(*a*) to 7(*c*), the rolling was performed in the state in which the temperature was maintained so as to be equal to or less than 1000 degrees C. On the other hand, FIGS. 7(*d*) to 7(*f*) show the temperature distribution results obtained when rolling the material with the rectangular section generally used in a conventional manner. In a case of the conventional shape, at the timing at which the outer diameter was increased by 20%, in the inner diameter corner portion, temperature was increased due to the heat of working, and the temperature increased up to approximately 1130 degrees C. In contrast, in cases of rolling the material 11 for ring rolling according to the Embodiment of the present invention, the temperature changed from a start of the rolling to an end thereof was 1000 degrees C. at the maximum, and it can be observed that the rolling was performed within the appropriate temperature range. Furthermore, FIGS. 8(*a*) and 8(*b*) show distribution maps of the distortion obtained by the numerical analysis for the material 11 for ring rolling according to the Embodiment of the present invention and the material for ring rolling with the conventional rectangular section at timing of end of the ring rolling process, respectively. Note that each of FIGS. 8(*a*) and 8(*b*) also shows the result of simulation for the upper half of the half section which is divided across the center line CL.

As will be understood from these results, in the case of a conventional technique, heating occurred due to deformation because of the deformation that had occurred centrally in the inner diameter corner portion. Furthermore, as a result of softening of the material that had occurred due to the heating, value of the distortion was locally equal to or greater than 4. On the other hand, in the case of the Embodiment of the present invention, when seeing the distortion in the inner diameter corner portion, the value of the distortion was approximately 2.5, and therefore, local deformation was reduced so as to be less than that in a conventional technique. Based on these results, it can be understood that deformation within the section is more uniform. When working distortion is provided on the Ni-based superalloy in a high temperature state, coarse grains are recrystallized into fine grains at the initial stage of the process, and as a result, the fine structure is obtained. Note that distortion is generally defined as "((Length after deformation)−(Length before deformation)/(Length before deformation)". Accordingly, the following conventional problem can be solved, that is to say, in the conventional problem, coarsening of grains occurs in portions, such as the inner diameter corner portion with excessively high temperatures, so that the distribution of distortion becomes non-uniform due to local deformation, and as a result, the structure becomes non-uniform.

Accordingly, even if a ring is formed in the same target shape as that targeted by the conventional technique, the shape according to the Embodiment of the present invention is applied to the material for ring rolling so that heating which occurs during rolling, can be suppressed, recrystallization for refining of the grains is advanced in a state in which growth of the crystal grains of the Ni-based superalloy is suppressed, and therefore, a ring with an excellent quality can be shaped by rolling. As described above, the shape of the material 11 for ring rolling according to the Embodiment of the present invention, includes a space which is formed between the height reducing portion 17 (having the tapered shape) and the maximum height portion of the material 11 for ring rolling, and plastic deformation is advanced such that the material gradually flows into the region in the course of the pressing. Therefore, local concentration of deformation is prevented, and deformation of the entire ring can be made uniform. As a result, occurrence of abnormally high heating is prevented, the heat load applied to the axial roll can be reduced to a low level, and therefore, life of the axial roll can be enhanced.

In contrast, in a case in which the conventional shape of a material for rolling is used, if the corner portion is filled with the material before completion of the rolling, the portion of the material in locations close to the corner portion is compressed between the mandrel roll 22 and the main roll 21 in the thickness direction, and therefore, the material which cannot be rolled in an appropriate direction flows in the height direction. On the other hand, the portions in the locations close to the corner portion is compressed between the upper and the lower axial rolls 23A and 23B in the height direction which is opposite to the above direction of flow of the material, and therefore, the material which cannot be rolled in an appropriate direction flows in the thickness direction. Accordingly, the deformation occurs repeatedly for each and every rotation, and as a result, heating occurs due to the deformation. In particular, since heat conductivity of Ni-based superalloys is low, once heating occurs, it takes time for temperature to decrease, and as a result, the temperature rises due to the repeated local deformation which occurs during the ring rolling. Therefore, the temperature of the material reaches 1050 degrees C. within a temperature region in which the crystal grains are coarsened, and therefore, the material may include portions with poor strength characteristics after the rolling is finished.

Examples of means for preventing this problem include means, such as water cooling, provision of extra shaped portions, reduction of the rolling speed, and the like. However, in the case of water cooling, it is significantly difficult to manage the temperature according to the progress of the rolling process. If any extra shaped portions are provided, and the margin for cutting off the extra shaped portions is provided, the material production yield may degrade, and required rolling capacity may be increased. If the rolling speed is reduced to suppress occurrence of heating in the corner portion, time taken until completion of the rolling may become longer, and therefore, this causes decrease of temperature in the other portions. For the material 11 for ring rolling according to the Embodiment of the present invention, the material is formed by using a preliminary process equivalent to that of the conventional technique. Furthermore, for the material 11 for ring rolling, a columnar billet is forged by upset hot forging, the center thereof is punched by using punching dies, and then, where necessary, the material is cut by machining so as to have the shape according to the Embodiment of the present invention. Therefore, the shape of the material for ring rolling described above can be easily obtained. Note that it is more suitable if a fillet portion (curved portion) is provided in connecting portions on each side edge thereof, because local contact with the axial roll can be prevented, and abrasion of the axial roll can be suppressed.

EXAMPLES

For an alloy equivalent to a 718 alloy used for a disk for a gas turbine of a diameter of Φ 1000 mm or larger, the forming method shown in FIG. 1 was applied to form the material 11 for ring rolling shown in FIG. 2. The dimensions of the material 11 for ring rolling were set so as to be the values shown in Table 1. Specifically, the outer peripheral portion 14 of the material 11 for ring rolling in contact with the main roll was formed so as to have the curved surface shape tapered toward the outer periphery. The shape of the half section of the material 11 for ring rolling included the height reducing portion 17 formed so as to reduce the height from the center line CL which divides the half section into halves in the height direction, toward the inner peripheral surface 13 which is in contact with the mandrel roll. Furthermore, the shape of the half section of the material 11 for ring rolling was formed with substantially linear symmetry so as to define the center line CL as the symmetrical axis. The center of gravity G on the half section of the material 11 for ring rolling was located so as to be closer to the side of the main roll than the center CP of the material 11 for ring rolling in the thickness direction, i.e., was located so as to be closer to the side of the outer peripheral surface 12.

TABLE 1

| Dimensions of material for ring rolling | |
|---|---|
| Outer diameter | 800 mm |
| Inner diameter | 404 mm |
| Thickness | 196 mm |
| Maximum height (H1) | 200 mm |
| Height of inner peripheral surface (Hin) | 48 mm |
| Length of height reducing portion | 126 mm |
| Length of linear portion | 20 mm |

Figure 6:
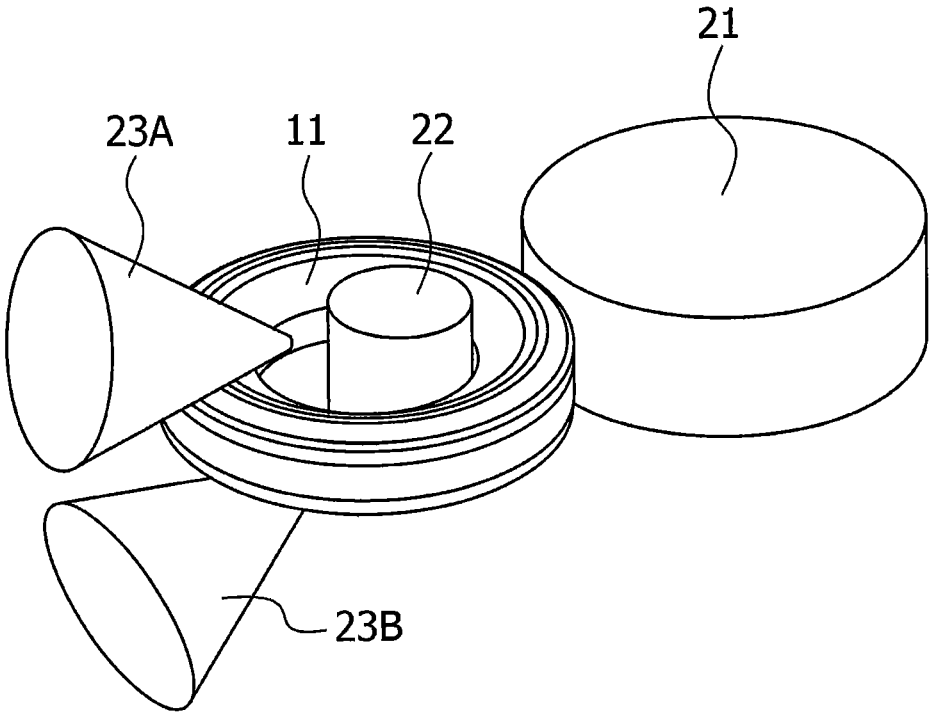
FIG. 6 is a perspective view which schematically shows a rolling process for the material for ring rolling according to the Embodiment of the present invention.
Figure 7A:
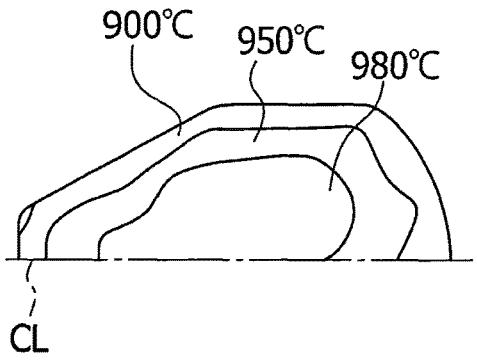
FIGS. 7(*a*) to 7(*c*) are diagrams each showing the temperature distribution obtained by numerical analysis practiced for an analysis example of the material for ring rolling according to the Embodiment of the present invention.
Figure 7D:
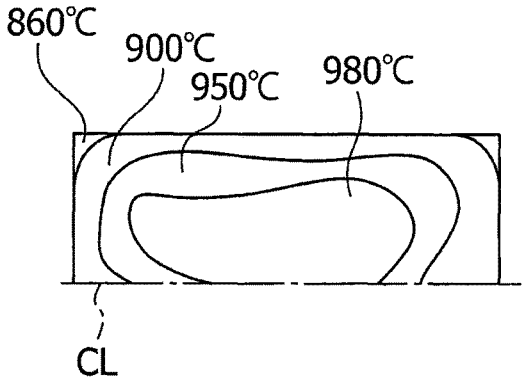
Figure 7B:
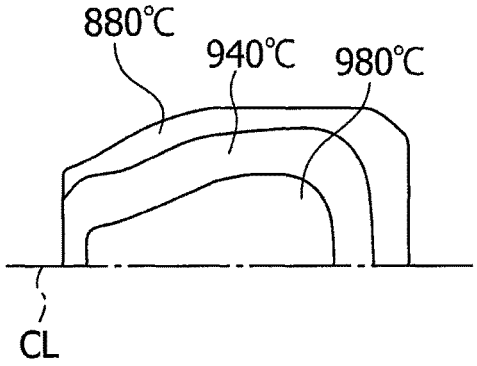
Figure 7E:
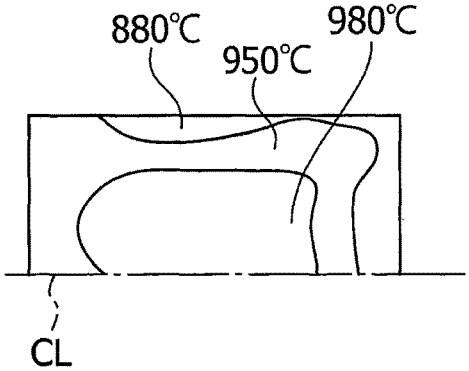
Figure 7C:
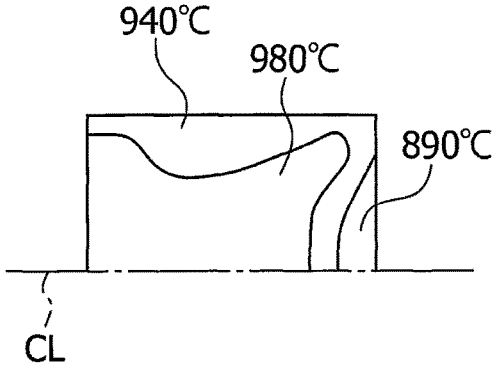
Figure 7F:
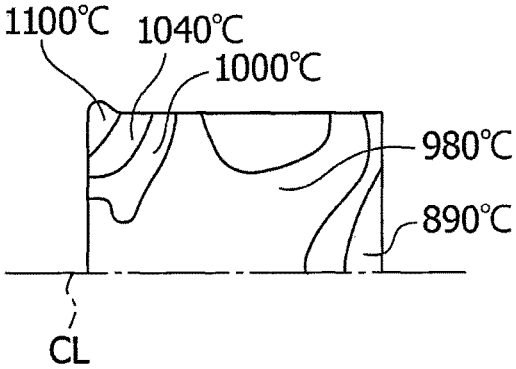

For the material 11 for ring rolling, ring rolling was performed by using the ring rolling mill shown in FIG. 6. The ring rolling mill used in this test, was provided with the guide rolls and the measuring roll. The material 11 for ring rolling was heated to 990 degrees C. before starting the ring rolling. During the ring rolling, similarly to the results of simulations described above, the deformation was advanced freely in the height direction in the region on the side of the inner peripheral surface 13, and it was not observed that heating at excessively high temperature occurs abnormally. Accordingly, the number of times of heating occurred was as little as twice, and the production time could be shortened. In addition, since the linear portion (flat portion) 15 including the end surface 16 in the height direction, which extended substantially so as to be linear, was provided between the outer peripheral portion 14 and the height reducing portion 17, the ring rolling could be stably performed when the material was pressed with the axial roll. By performing the ring rolling in this manner, the material 11 for ring rolling including a rectangular shape, which had an outer diameter of 1141 mm, an inner diameter of 933 mm, a thickness of 104 mm, and a height of 189 mm, could be obtained. The material 11 for ring rolling was subjected to visual inspection of its appearance, and then, it was inspected for defects such as cracking, chipping, and these were not found for the material 11 for ring rolling, and the material 11 for ring rolling was formed in a substantially true-circular shape.

Test pieces for observation of the metal structure were sampled from the material 11 for ring rolling. The sampling portions were the upper portion, the inner diameter portion, the center portion, the outer diameter portion, and the lower portion of the material 11 for ring rolling (the ring mill rolling material). The metal structure of the material 11 for ring rolling was observed by using an optical microscope, and furthermore, the grain size number was measured. The measurement of the grain size was practiced according to the measurement method provided by ASTM-E112. The results of the measurement of the grain size are shown in Table 2, and photographs of the metal structure are shown in FIG. 9.

TABLE 2

| Observed portions | Average grain size number |
|---|---|
| Upper portion | 11 |
| Inner diameter portion | 11 |
| Center portion | 10.5 |
| Outer diameter portion | 11 |
| Lower portion | 10 |

According to the results of the observation of the metal structure and the results of measurement of the average grain size on the section, it can be understood that the crystal grains were uniform and fine in the material for ring rolling which was produced by using the material 11 for ring rolling according to the Embodiment of the present invention. Accordingly, it was verified that uniform and optimum distortion was applied onto the entire surface of the material 11 for ring rolling, and this material 11 for ring rolling was suitable to be employed as a material of a rotational component which was used for a high temperature portion of a gas turbine.

REFERENCE SIGNS LIST

1 Ni-based superalloy for ring rolling
2 Upper die (upper molding die)
3 Lower die (lower molding die)
4 Thin portion
11 Material for ring rolling
12 Outer peripheral surface
12*a* End portion
12*b* Upper portion
12*c* Lower portion
12*d* Intermediate portion
13 Inner peripheral surface
13*a* End portion
14 Outer peripheral portion
15 Linear portion
16 End surface
17 Height reducing portion
18 Slanted surface
21 Main roll
22 Mandrel roll
23A Upper axial roll
23B Lower axial roll
CA Central axis
CP Center
CL Center line
Hin Height of inner peripheral surface
H1 Maximum height of material for ring rolling
θin Angle

The invention claimed is:

1. A material for ring rolling including a radially outer peripheral surface and a radially inner peripheral surface, the material for ring rolling to be formed by hot rolling in which a ring rolling mill having a main roll and a mandrel roll is used and the hot rolling is performed in a manner of reducing an interval in a radial direction of the material for ring rolling between the main roll and the mandrel roll, the main roll and the mandrel roll respectively arranged on and in contact with the outer peripheral surface and the inner peripheral surface so as to face each other, wherein:

a center of gravity on a half section of the material for ring rolling is located so as to be closer to the outer peripheral surface than a center of the half section in a thickness direction of the half section;

the material for ring rolling is formed such that a shape of the half section includes a height reducing portion having a height from a center line which divides the half section into halves in a height direction of the half section, the height of the height reducing portion is gradually reduced toward the inner peripheral surface and the shape of the half section is formed in a substantially linear symmetry so as to define the center line as a symmetrical axis of the half section;

the shape of the half section further includes a linear portion arranged between the outer peripheral portion in which the outer peripheral surface is provided, and the height reducing portion, the linear portion includes both end surfaces in the height direction and is extended so as to be substantially linear, and a length of the linear portion in the thickness direction is more than 0 times and is ⅔ times or less of the maximum height of the material for ring rolling; and a height of the inner peripheral surface is from 20% to 50% of a maximum height of the material for ring rolling.

2. The material for ring rolling according to claim 1, wherein a length of the height reducing portion in the thickness direction is from 0.2 times to 1.5 times of the maximum height of the material for ring rolling.

3. The material for ring rolling according to claim 1, wherein the outer peripheral surface is provided in an outer peripheral portion, the outer peripheral portion is formed so as to be tapered toward an outer periphery of the material for ring rolling.

* * * * *